US011300392B1

(12) United States Patent
Zoltan

(10) Patent No.: US 11,300,392 B1
(45) Date of Patent: Apr. 12, 2022

(54) A.Z.G. TRI GRENADE

(71) Applicant: Attila G. Zoltan, Houston, TX (US)

(72) Inventor: Attila G. Zoltan, Houston, TX (US)

( * ) Notice: Subject to any disclaimer, the term of this patent is extended or adjusted under 35 U.S.C. 154(b) by 0 days.

(21) Appl. No.: 17/247,715

(22) Filed: Dec. 21, 2020

(51) Int. Cl.
*F42B 27/00* (2006.01)

(52) U.S. Cl.
CPC ..... *F42B 27/00* (2013.01)

(58) Field of Classification Search
CPC ..... F42B 27/00
USPC ..... D22/112
See application file for complete search history.

(56) References Cited

U.S. PATENT DOCUMENTS 4,947,753 A * 8/1990 Nixon, III ..... F42B 8/26 102/269
5,196,649 A * 3/1993 DiRubbio ..... F42B 27/08 102/486
D603,930 S * 11/2009 Cirinelli ..... D22/112
D642,235 S * 7/2011 Harasts ..... F42B 12/36 D22/112
8,161,883 B1 * 4/2012 Harasts ..... F42B 12/42 102/482
9,255,777 B1 * 2/2016 Campagnuolo ..... F42B 3/10
10,030,955 B1 * 7/2018 Sapp ..... F42C 14/02
10,317,182 B1 * 6/2019 Elalem ..... F42C 9/10
2008/0156220 A1 * 7/2008 Tanguy ..... F42B 12/24 102/482
2020/0149851 A1 * 5/2020 Wustlich ..... F42B 27/00

* cited by examiner

*Primary Examiner* — Gabriel J. Klein

(57) ABSTRACT

A hand-throwable grenade shaped in a triangular form to provide more sturdiness and accuracy when thrown. The unique shape of this grenade allows for a more comfortable hold and prevents the grenade from rolling away or back from desired target. Not only was it designed with versatility, but the grenade allows the user to infuse it with different materials. These materials include C4, gunpowder, tear gas, and any kind of chemical. This grenade was invented with the Armed Forces and a special application in mind.

1 Claim, 8 Drawing Sheets

A.Z.G. TRI GRENADE

BACKGROUND OF THE INVENTION

Field of Invention

The present invention relates to fused, hand grenades with a unique shape and one size fits all application.

Modern grenades that are designed for the US forces are often found in shapes such as round and oval. However, when grenades are thrown they don't always stay on target. They can roll beyond target or back to the soldier. This is a safety issue in a situation of war.

Different types of grenades are manufactured for different circumstances. Currently, there is no "one size fits all" grenade. With this in mind, the T.R.I. Grenade was made.

BRIEF SUMMARY OF THE INVENTION

The present invention relates to fused hand grenades with a shape to allow for more control. Hand grenades are small sized bombs which can be thrown by hand. There are three types of grenades: chemical, gas, and explosive. This grenade in particular can be used for all of the above. Modern hand grenades are specifically designed for particular circumstances both in warfare and civil situations. With the T.R.I. Grenade, this differentiation is not necessary since one size fits all. The T.R.I. Grenade can be used far all circumstances. The only difference is the substance it is infused with.

Modern hand grenades manufactured for US forces are shaped in a ball or rounded shape with no harsh edges. With this in mind, the T.R.I. Grenade was manufactured in a triangular shape. The shape of this grenade allows for more control and comfort for the user. Due to its shape, the grenade will not roll beyond its target. Where it is thrown and aimed to is where it will stay. With a triangular, cylinder-like shape, the grenade will always land on a flat surface. The force at which it is thrown does not matter its shape will force the grenade to stop. The fuse found within the grenade was designed with openings, slots, on the cylinder in order to allow for the substance to be more effective during explosion. In instances of tear gas, these openings allow for an even distribution throughout the chambers of the grenade. It also allows for the housing of the grenade to break and explode in a more efficient manner during lethal detonation.

BRIEF DESCRIPTION OF DRAWINGS

As mentioned above, the TRI Grenade presents a unique body shape which differs from all predecessors. For better understanding, please see below the represented drawings in a more detailed approach.

DETAILED DESCRIPTION OF THE INVENTION

The information below refers to the drawings in detail to explain the purpose of each featured numbered part. Here are the necessary features and their purpose explained in greater detail.

Figure 1:
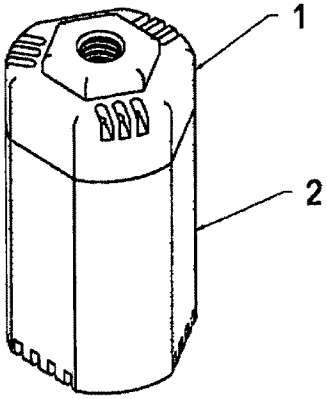
FIG. 1 shows the side view TRI Grenade body: Top (1) section for the grenade. Bottom (2) section.

FIG. 1 presents the body and shape of the TRI Grenade. It is cut in a cylinder shape, and every 120 degrees is a flat surface allowing the Grenade to take up a triangular shape. The sharp edges are rounded around 3/32 inches radius, making it smooth and easy to hold in anyone's hands. The TRI body comes together with two parts: Top (1) section and Bottom (2) section. Two parts are connected together with 2 inch threads, Top (1) section is 2.00"-12 2A thread. Bottom (2) section is 2.00"-12-2B thread. When the two parts are twisted together the thread allows for lightening of the Top (1) piece with the Bottom (2) section. This also allows two pieces to look as one whole piece to the naked eye.

Figure 2:
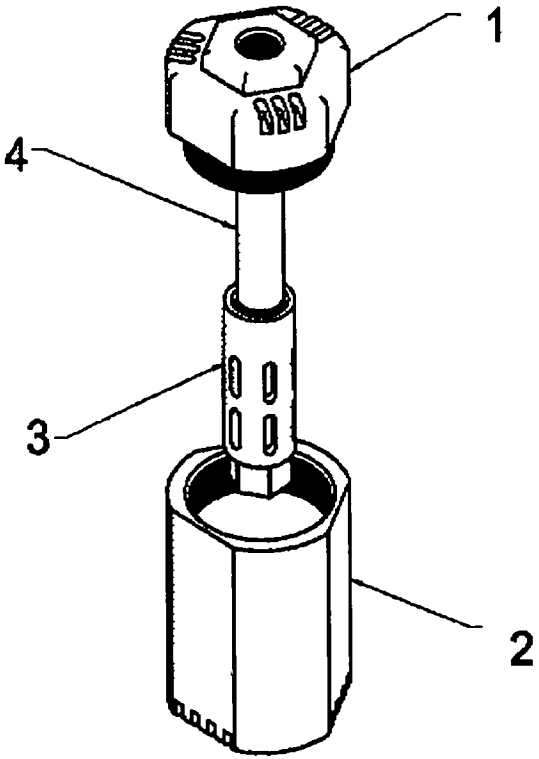
FIG. 2 shows the main parts of the TRI Grenade: Top (1) section, Bottom (2) section, Fuse (3) body, Container (4) sleeve.

FIG. 2 shows the whole invention, piece by piece, separately. It also shows how the Top (1) section, Fuse (3) body, and the Container (4) sleeve come together. This allows for the Container (4) sleeve to slide freely. The Top (1) section makes a connection with the Fuse (3) body, as they turn which ¾-10 inches thread. This holds both pieces together as one unit. As the Top (1) unit connects with the Bottom (2) unit, it will turn and connect with 2.00-12 inches thread. This allows the whole TRI Grenade to be a single unit.

Figure 3:
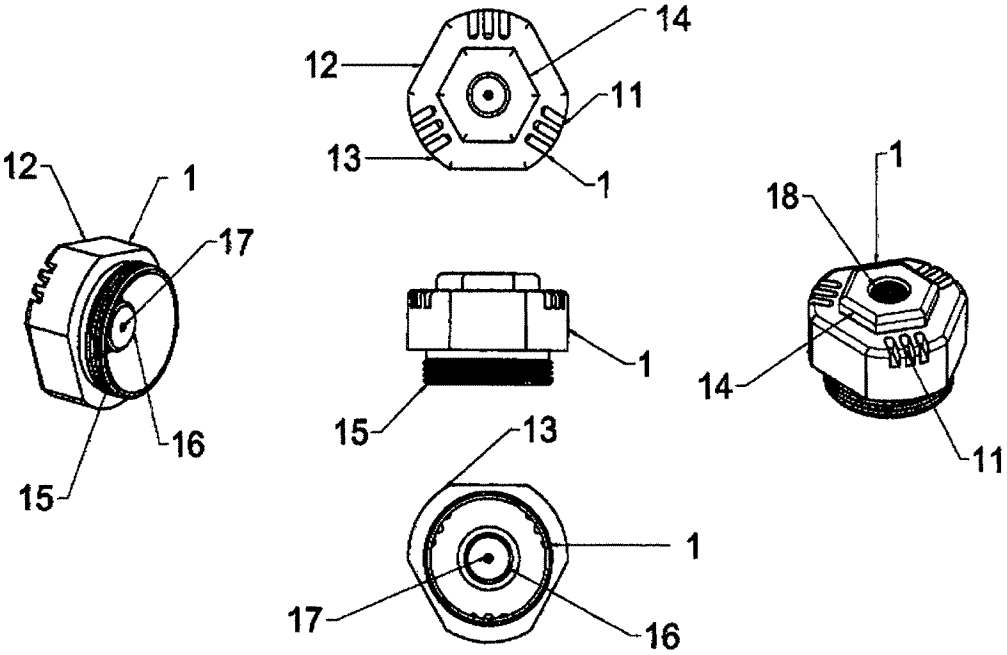
FIG. 3 Side shows the top and isometric view of TRI Grenade Top (1) section with detailed explanation of the figures from Numbers 11-18.

FIG. 3 displays the detailed view for the Top (1) section for TRI Grenade body. Number 11 shows the slots and cutouts on the piece which has two functions. As the housing weakens during explosion, the force allows the material to tear easily. Another function of the grenade would be for the use of gas and chemical weapons. The slots on Number 11 indicate how gas and chemical materials would be released from the inside to the outride.

The flats from Number 12, on the cylinder body, can be found every 120 degrees, longitude. The purpose is to reduce and stop the rolling motion for the cylinder body. This is the most important contrasts of the invention.

Number 13 shows the radius on every 120th degree, of the housing and how it's distributed equally. The purpose is to represent a situation where you need to roll to your grenade somewhere with limitation.

Number 14 shows the hexagonal shape from Top (1) section. The purpose is shown in the assembly. When assembled together, a wrench can be used in order to tighten the housing parts into one unit.

Number 15 shows the thread size, which is 2.00-12 inches and 2A. The purpose is to connect the Top (1) section with the Bottom (2) section.

Number 16 illustrates the internal three, which is located on the Top (1) section. The size of this part is ¾-10 inches and 2A. It is located inside of the chamber. This thread holds together the Fuse (3) body and the Top (1) section.

Number 17 shows the Hole going through the grenade vertically in the Top (1) piece. It is measured at 0.06 inches, and it's purpose is for the detonator pin. This activates the explosive or chemical material in the Fuse (3) body.

Number 18 represents the thread's internal sizes. A ⅝-11-2B thread is placed to hold Number 5, the M201 A1 Trigger body.

Figure 4:
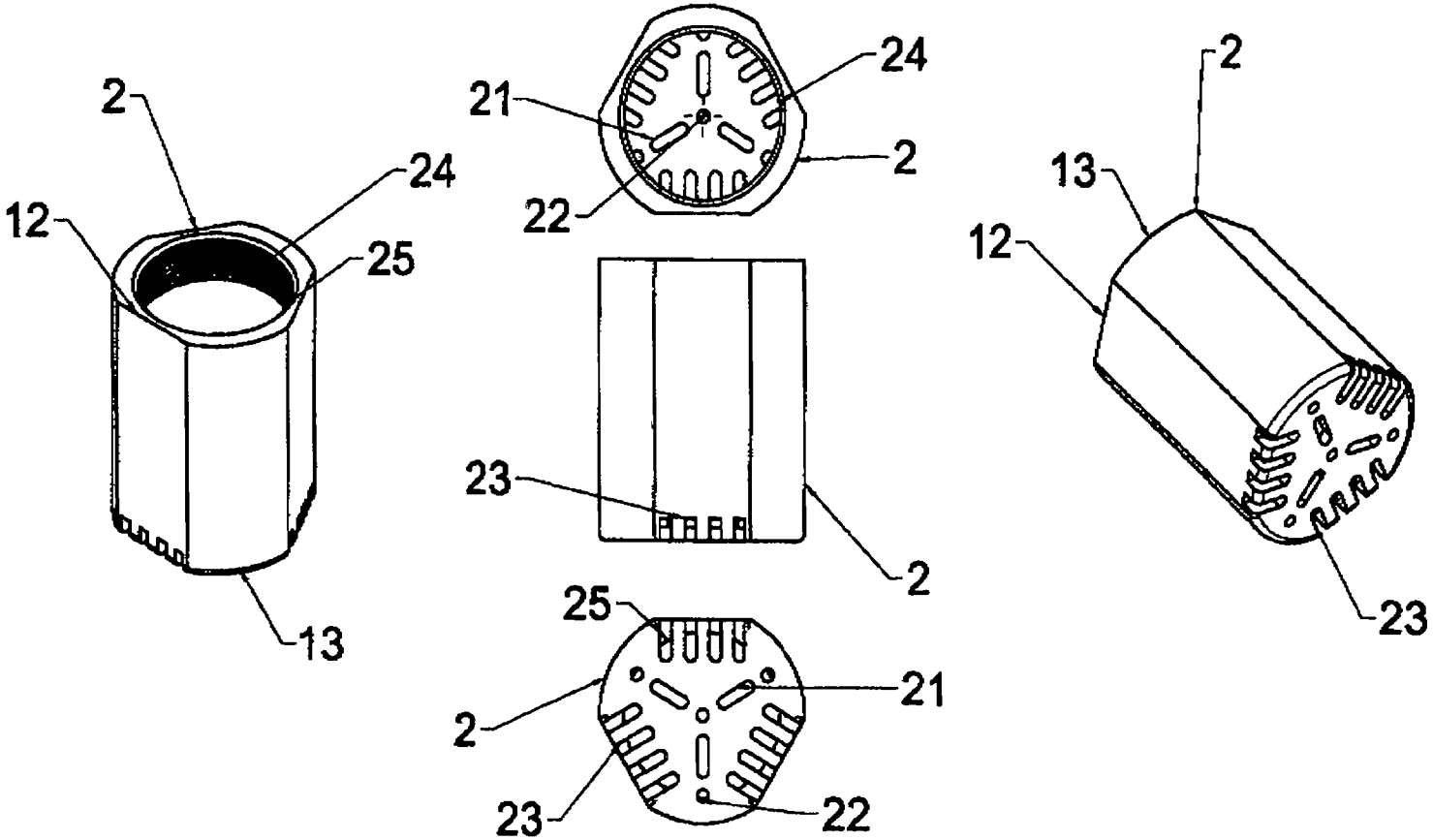
FIG. 4 Side demonstrates top and isometric view of TRI Grenade Bottom (2) section with detailed explanation of figures on piece Numbers 21-25.

FIG. 4 shows the detailed view from the side, top, and bottom. It is isometric. Number 2 indicates the Bottom section for TRI Grenade housing. Number 21 slots through the bottom for the 2 Bottom section. It is positioned equally and evenly every 120 degrees. There are two purposes for this mechanism. First, this distribution allows for the release of chemicals and gas from the chamber. Second, it creates a breaking point in the material, which easily falls apart from the explosive force. The same principal follows for the Number 22 holes. Four of them are found on the bottom. The function is same as Number 21 slots.

The slots from Number 23 width are the same as Number 21 slots. The difference between Number 23 slot and Number 21 slot is the location of each. Even though they are both on Bottom 2. Number 23 is on the edge while Number 21 is directly on the bottom of the surface. These four slots can be found evenly every 120 degrees. The slots from Number 23 serve the same purpose as Number 11 slots. This allows for the weakening of the material for an explosive force, and the of release chemicals or gas from the chamber.

Looking at FIG. 1, the slots relation from the Top 1 section and the Bottom 2 section are in relation to each other. These slots are 60 degrees in orientation. Number 24 Internal thread 2.00"-12-2B makes a connection with Top 1 section 2.00"-12-2A thread. Number 25 The internal chamber sires are as follows. The Bottom 2 Section is 1.9 indies and is circular shape. For Top 1 section, the thickness of the material is 0.15 inches around, which is identical to the Bottom 2 part.

Figure 5:
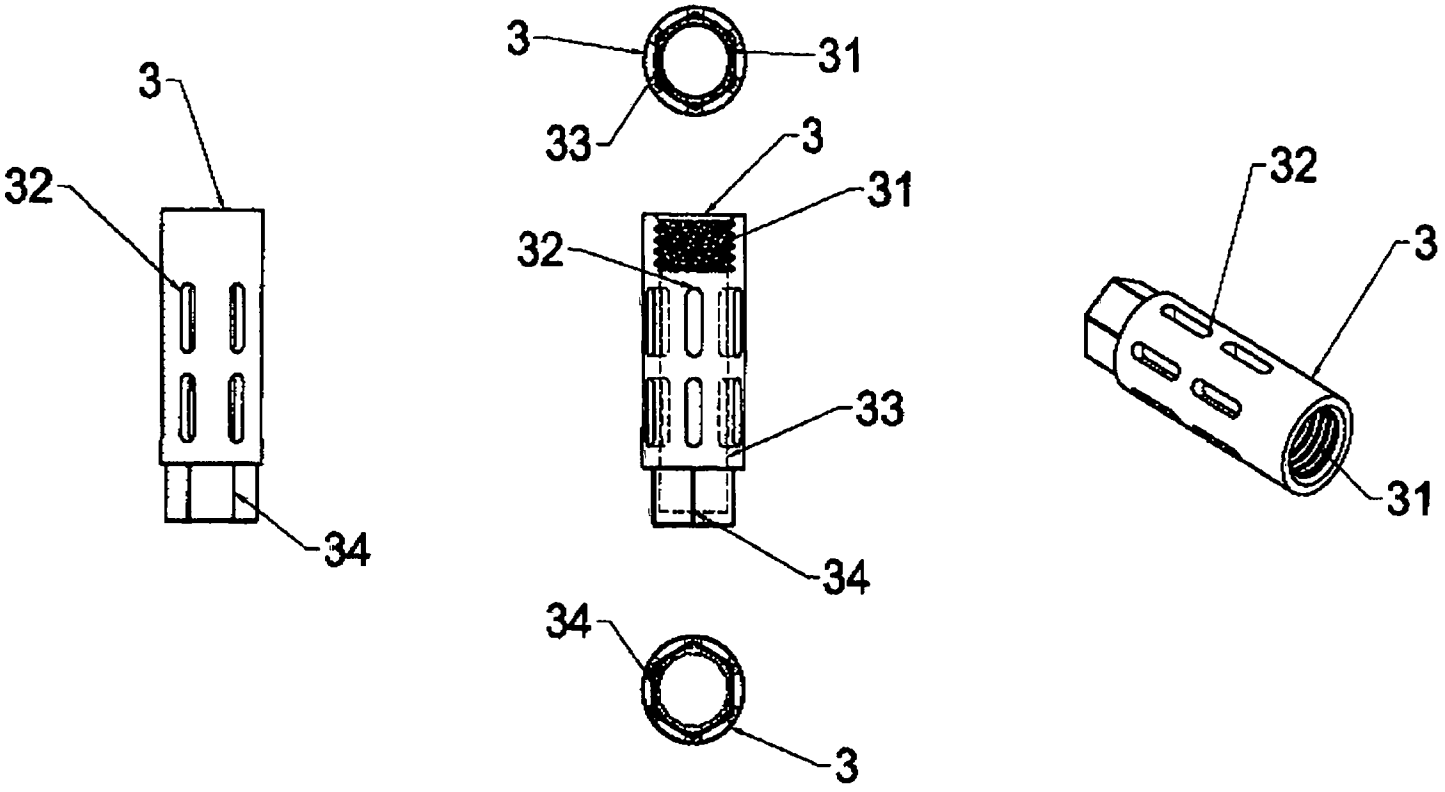
FIG. 5 shows the side, top, and isometric view of TRI Grenade with Fuse (3) Body. It represents the internal parts for the grenade to hold explosives, such as chemical or gas. Detailed explanation of figures can be found from Numbers 31-34.

The FIG. 5 Drawing demonstrates the side, top, bottom, and isometric view. The Fuse 3 body is a cylinder shape piece that is hollow inside. The purpose of the Fuse 3 body is to hold the explosive, gas or chemical materials in the Number 33 chamber. The size of the chamber is 0.625 inches internal counterbore. That way, the user is able to slide in Container 4 sleeve, which holds in the explosive or chemical materials in the Fuse 3 body. Number 31 is the thread ¾"10-2B. This thread makes a connection unit with the Top 1 section, ¾"-10-2A thread. Number 32 slots can be found on the Fuse 3 cylindrical shape. Each row has two slots in a 60 degree pattern, allowing for 12 slots found on the Fuse 3 to be all together. The purpose of this is to allow for a fast release of explosive force, which releases chemicals or gas material freely to the environment without any blockage. Number 34 shows a hexagonal shape, which is the bottom view of the Fuse 3 body. A ¾ inch socket or a ¾ wrench would be useful to tighten the Top 1 section and Fuse 3 Body for assembly.

Figure 6:
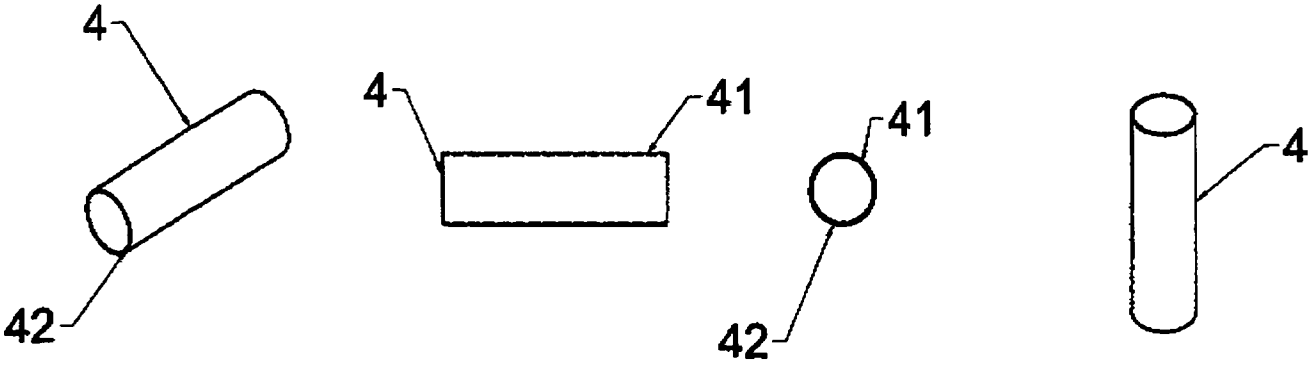
FIG. 6 demonstrates the side, top, and isometric view of TRI Grenade with Container (4) sleeve, which is the internal part for Fuse (3) Body. It holds explosive, chemical, or gas material in the fuse. Detailed explanations are provided with Numbers 41-42.

FIG. 6 shown the top, side, and isometric view of the Container 4 sleeve. The aluminum sleeve is solely responsible for holding in unstable explosive or chemical materials in the Fuse 3 chamber. This piece of the invention is cylinder. Number 41 has inside dimension of 0.58 inches and the outside dimension of Number 42 is 0.62 inches. The wall thickness for the sleeve is 0.02 inches, which allows for the Fuse 3 chamber to slide in perfectly.

Figure 7:
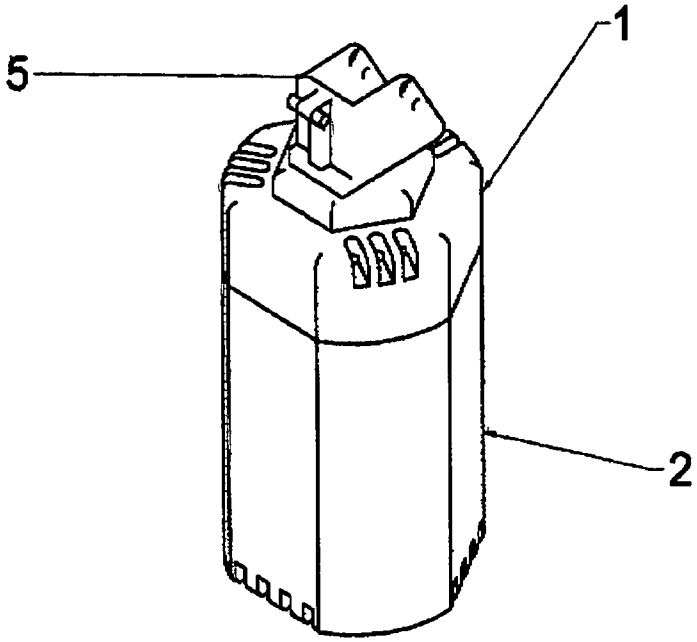
FIG. 7 represents the North East side view of the TRI Grenade, assembling Top (1) section, Bottom (2) section, and M201 A1 Trigger (5) body, (excluded from invention but important for the activation for the TRI Grenade). It is supplied by military part suppliers, and these supplies include trigger assembly.

FIG. 7 shows the isometric view of the whole TRI Grenade. The drawing also shows the main parts for the grenade: Top 1 section, Bottom 2 section and Trigger 5 body M201 A1

Figure 8:
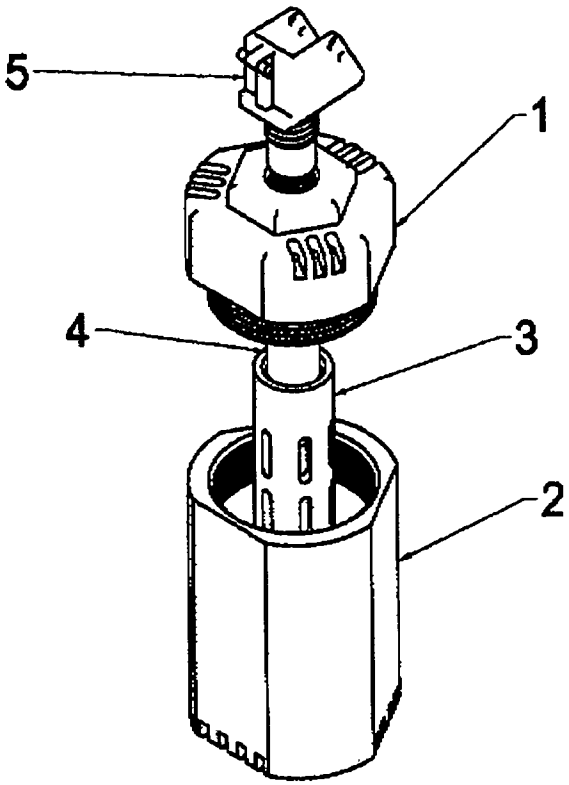
FIG. 8 shows the North East side view of TRI Grenade. The figure shows the full assembly and how the parts are connected with each other. These parts include the Top (1) section, with the Fuse (3) body. Container (4) sleeve and the Bottom (2) section.

FIG. 8 it the isometric view shows the coming together of the TRI Grenade and whole assembly from top to bottom. The drawing shows 1 Top section, 2 Bottom section 3, Fuse 4 Container sleeve, and 5 Trigger body M201 A1.

I claim:

1. A grenade comprising:

a grenade body having atop section threadedly attached to a bottom section and a longitudinal axis extending through the top section and the bottom section;

the top section having three top-section flat sides and three top-section rounded sides, the top-section flat sides and the top-section rounded sides alternating every 60° about the longitudinal axis of the grenade body, each top-section flat side having no slots formed at atop edge thereof, and each top-section rounded side having three slots formed at a too edge thereof to creates areas of weakness;

a bottom section having three bottom-section flat sides and three bottom-section rounded sides, the bottom-section flat sides and the bottom-section rounded sides alternating every 60° about the longitudinal axis of the grenade body, each bottom-section rounded side having no slots formed at a bottom edge thereof, and each bottom-section flat side having four slots formed at a bottom edge thereof to create areas of weakness;

the top section further including a hexagonal head extending from a top side thereof for engagement with a wrench to tighten the top section to the bottom section;

the bottom section further inducing a bottom side having three slots formed there-through and positioned equally and evenly every 120° to create breaking points;

the bottom side of the bottom section further including four circular holes to create additional breaking points;

a fuse threadedly connected to the top section and contained within the grenade body, the fuse having twelve slots formed through a cylindrical sidewall of the fuse to allow for release of explosive force, and the fuse including a hexagonal bottom portion for engagement with a wrench;

a container sleeve disposed within the fuse, the container sleeve holding explosive or chemical materials, and a trigger threadedly connected to the top section, aligned with the fuse, and extending upward from the top section;

wherein the top-section flats sides are aligned with the bottom-section flat sides and the top-section rounded sides are aligned with the bottom-section rounded sides, in order to mitigate rolling of the grenade on a ground surface.

* * * * *